US006685075B1

(12) United States Patent
Kannankeril

(10) Patent No.: US 6,685,075 B1
(45) Date of Patent: Feb. 3, 2004

(54) PIVOTING ARM BAG DISPENSER AND BAG DISPENSING SYSTEM

(75) Inventor: Charles Paul Kannankeril, North Caldwell, NJ (US)

(73) Assignee: Crown Poly, Inc., Huntington Park, CA (US)

( * ) Notice: Subject to any disclaimer, the term of this patent is extended or adjusted under 35 U.S.C. 154(b) by 0 days.

(21) Appl. No.: 09/641,874

(22) Filed: Aug. 18, 2000

(51) Int. Cl.[7] ..... B26F 3/02

(52) U.S. Cl. ..... 225/96; 225/51; 225/106; 248/175

(58) Field of Search ..... 225/106, 93, 42, 225/46, 47, 51, 52, 79, 82, 84, 96; 206/389, 554; 248/95, 100, 175; 383/37; 83/649, 650, 949; 242/416, 419, 419.5, 419.8, 421.8, 422.4, 422.5

(56) References Cited

U.S. PATENT DOCUMENTS

| | | | | | |
|---|---|---|---|---|---|
| 1,778,282 | A | * | 10/1930 | Stewart | 242/596.3 |
| 1,897,266 | A | * | 2/1933 | McGeoch et al. | 242/596.1 |
| 2,034,602 | A | * | 2/1936 | McDonough et al. | 225/67 |
| 2,462,776 | A | * | 2/1949 | Price | 225/33 |
| 2,467,825 | A | * | 4/1949 | Hall | 242/596.1 |
| 2,661,165 | A | * | 12/1953 | Salmonson | 242/422.5 |
| 3,227,386 | A | * | 1/1966 | Pitcher | 242/129.5 |
| 4,828,193 | A | * | 5/1989 | Galbraith | 225/106 |
| 4,904,092 | A | * | 2/1990 | Campbell et al. | 206/390 |
| 5,054,675 | A | * | 10/1991 | Taves | 225/19 |
| 5,209,371 | A | * | 5/1993 | Daniels | 221/63 |
| 5,219,424 | A | * | 6/1993 | Simhaee | 225/106 |
| 5,556,019 | A | * | 9/1996 | Morris | 225/106 |
| 5,573,168 | A | * | 11/1996 | Kannankeril et al. | 225/106 |
| 5,706,993 | A | * | 1/1998 | DeMatteis | 225/106 |
| 5,727,721 | A | * | 3/1998 | Guido et al. | 221/63 |
| 5,752,666 | A | * | 5/1998 | Simhaee | 206/390 |
| 5,813,585 | A | * | 9/1998 | Kannankeril et al. | 225/106 |
| 5,934,535 | A | * | 8/1999 | Kannankeril et al. | 225/106 |
| 6,089,514 | A | * | 7/2000 | Huang et al. | 248/95 |
| 6,135,281 | A | * | 10/2000 | Simhaee | 206/390 |
| 6,230,953 | B1 | * | 5/2001 | Simhaee | 225/46 |
| 6,234,431 | B1 | * | 5/2001 | Simhaee | 248/118 |
| 6,279,806 | B1 | * | 8/2001 | Simhaee | 225/106 |
| 6,305,572 | B1 | * | 10/2001 | Daniels et al. | 206/390 |

* cited by examiner

*Primary Examiner*—Allan N. Shoap
*Assistant Examiner*—Stephen Choi
(74) *Attorney, Agent, or Firm*—Darby & Darby

(57) ABSTRACT

The present invention provides a dispenser for serially dispensing plastic bags from a wound roll of plastic bags. The dispenser includes a support member which is attachable to a support surface, a pivotable arm that can pivot between a roll-loading position and bag-dispensing positions, a braking surface to prevent freewheeling, a mechanism to prevent axial movement of the roll of bags on the pivotable arm, and a tongue positioned to engage an opening between bags while the bags are dispensed. A dispensing system combines the dispenser with a roll of plastic bags having an axial passageway through the center of the roll. The dispenser can dispense a wound roll of bags that has a core or is coreless. The sides of the core can be flush with the sides of the roll of bags, can extend from the sides of the roll of bags, or can have a combination thereof.

20 Claims, 11 Drawing Sheets

PIVOTING ARM BAG DISPENSER AND BAG DISPENSING SYSTEM

FIELD OF THE INVENTION

The present invention relates generally to dispensers for dispensing plastic bags from a roll of plastic bags, as well as to bag dispensing systems in which plastic bags are dispensed from a roll of plastic bags retained in a dispenser especially adapted for dispensing the bags individually from the roll.

BACKGROUND OF THE INVENTION

In recent years, various systems for dispensing bags have been developed, these systems providing a mechanism for dispensing individual bags from a roll of interconnected bags separated from one another by a line of perforations containing a centrally-located slit. The dispensing system employs a tongue to assist a user in separating the most downstream bag from the next bag on the roll. That is, when the roll of interconnected bags is unrolled so that the slit between two bags snags on the upstanding tongue member, the user continues to pull, causing the upstream bag to be separated from the adjacent downstream bag by tearing across the line of perforations until the bags are completely separated.

Most of these bag dispensing systems have utilized a roll of bags in which the bags are wound around a core, with the ends of the core extending axially from the roll of bags. Most of the various dispensers in the marketplace have guides or channels which confine the axial movement of the roll of bags, in order to retain the roll of bags in the dispenser and to allow the roll of bags to rotate during dispensing of individual bags from the roll. The core is generally a hollow plastic tube having a weight which is only a small fraction of the weight of the full roll of bags on the core.

As a result, when the roll becomes severely depleted of bags, the core tends to jump around in the dispenser channels or guides which otherwise confine the location of the roll of bags. In addition, the light weight and smaller diameter of the depleted roll of bags causes the depleted roll of bags to rotate at a greater rate, also leading to instability of the roll in the dispenser, which can lead to the depleted roll of bags becoming skewed in the channels, and even jumping out of the guide channels or other structure, necessitating reinsertion of the roll in the proper position in the dispenser. The light weight of the depleted roll of bags also reduces the amount of friction between the depleted roll and one or more braking surfaces in contact with the depleted roll. It would be desirable to reduce or eliminate these problems.

Since there are at least two different manufacturers of such rolls of bags in the marketplace today, it has been found that rolls of bags from different manufacturers are interchangeable between dispensers of different brands, which is undesirable because retail stores (providing the bags for the convenience of consumers) lease the dispensers free of charge so long as the bags are purchased from the supplier of the dispensers. It would be desirable to provide a roll of bags which differs from the present rolls, in order to reduce or eliminate the use of bags from one manufacturer in a dispenser provided by another manufacturer.

Finally, U.S. Pat. No. 5,752,666 is directed to a plastic bag roll in which bags are wound on an axle which is axially longer than the roll is wide. It would be desirable to provide a dispensing system which utilizes a roll of plastic bags wound on an axle which is not axially longer than the roll is wide, while at the same time solving the various problems described above.

SUMMARY OF THE INVENTION

The present invention effectively solves all of the above-described problems by providing a dispenser with a pivoting arm having an extending member which passes through the roll of bags, in combination with means for limiting the axial movement of the roll of bags when the roll is loaded into the dispenser in a position for bags to be individually dispensed. The limiting of the axial movement can be provided entirely by the structure of the swinging arm itself and fixtures thereon. Alternatively, the dispenser can be provided with features separate from the pivoting arm which can be used to limit the axial movement of the roll of bags once it is in position for dispensing of bags.

Moreover, the bags can be wound on a core which is no longer than the roll is wide. The core can have ends which are flush with the sides of the roll of bags. The design of the dispenser controls the position of the roll of bags even as the roll is severely depleted, preventing the roll of bags from jumping out of position as the last bags are dispensed from the roll. The design of the dispenser also enhances the frictional contact of a severely depleted roll of bags relative to the plastic bag dispensers of the prior art, to prevent undesirable freewheeling until the last bag is dispensed from the roll. Furthermore, a roll of bags having a core having ends flush with the roll of bags provides the additional advantage of eliminating "telescoping" of the roll during shipment. That is, rolls of bags wound on a core with extending ends allows the bags to telescope during shipment, and undesirable effect. The dispensing system of the present invention permits the use of a "flush core roll" which can be shipped without telescoping.

As a first aspect, the present invention is directed to a dispenser for serially dispensing plastic bags from a wound roll of plastic bags. The dispenser comprises a support member which is attachable to a support surface, a pivotable arm attached to the support member, the pivotable arm including means for pivoting from a roll-loading position to a bag-dispensing position, means for braking the wound roll of bags to retard freewheeling of the wound roll during dispensing of individual bags, means for limiting axial movement of the roll of bags on the pivotable arm when the pivotable arm is in the bag-dispensing position, and a tongue attached directly or indirectly to the support member, the tongue being positioned for engaging a slit between bags during dispensing of the bags. The pivotable arm has an axial portion having a free end for installation thereon of the wound roll of bags, and a radial portion extending from the support member to the axial portion.

Preferably, the axial portion of the pivotable arm is horizontally positioned. Preferably, the radial portion of the pivotable arm pivots through a vertical plane. Preferably, the angle between the axial portion and the radial portion of the pivotable arm is 90 degrees. Preferably, the axial portion comprises a U-shaped rod, with the width of the "U" being designed to fit within a passageway through the roll of bags and/or through the hollow core on which the bags are wound. In another embodiment, the axial portion of the arm has a sleeve thereon which fits within the hollow core of the roll of bags and which frictionally engages the axial portion of the arm. The axial portion of the arm can also have a weight added thereto, to further stabilize the roll of plastic bags as it becomes depleted. Preferably, the means for pivoting comprises a hinge between the support member and the radial portion of the pivotable arm.

Preferably, the means for limiting the axial movement of the roll of bags on the pivotable arm comprises a side rail attached to the support member, the side rail being on a first side of the dispenser which corresponds with the free end of the axial portion of the pivotable arm. Preferably, the means for limiting the axial movement of the roll of bags on the pivotable arm further comprises a second side rail attached to the support member, wherein the second side rail is on a second side of the dispenser which corresponds with the radial portion of the pivotable arm.

Preferably, the means for braking the wound roll of bags comprises a braking surface in contact with an outer curved surface of the roll of bags when the pivotable arm is in the bag-dispensing position. Preferably, the braking surface comprises a pair of narrow brake plates positioned to contact outer edge regions of the curved outer surface of the cylindrical roll of bags. Preferably, the bags have centrally-positioned printing, with the brake plates sized and positioned to contact only outer edge portions of the outer curved surface of the roll of bags, with the plastic in contact with the print (i.e., plastic having ink transferred from the print) passing between the brake plates, i.e., not contacting the brake plates. Preferably, the narrow brake plates each contact the outer ⅛-inch to 1-inch of the outer curved surface of the cylindrical roll of bags; more preferably, from ¼-inch to ¾ inch; more preferably, about ½-inch.

Alternatively, the means for braking the wound roll of plastic bags can comprise a roll-engaging member which engages the roll of plastic bags and rotates with the roll of plastic bags as the bags are being dispensed. This roll-engaging member is designed to provide rotational friction between itself and the axial portion of the pivotable arm. For example, a braking member of this type would be a cylinder which is sized to fit snugly into a core on which the bags are wound, with the cylinder being in frictional engagement with the axial portion of the pivotable arm.

Preferably, the dispenser is designed to accept and dispense two different kinds of rolls of plastic bags: (1) a roll of plastic bags wound on a core having end portions which extend axially from the wound bags, as well as (2) a roll of plastic bags wound on a core having ends which are flush with side surfaces of the wound roll of bags. In addition, the dispenser can be designed to accept and dispense a roll of plastic bags wound on a core having one end which is flush with a side of the roll of bags, and a second end which extends axially from the roll of bags. In each instance, the roll of plastic bags is preferably of "standard width" used commercially. Currently, that width is about 3¾ inches.

Preferably, the tongue is a double tongue mounted on a tongue support member, with the tongue support member being directly or indirectly attached to the support member. Preferably, the double tongue has an upper tongue extending above the tongue support member, and a lower tongue extending below the tongue support member. The upper tongue is used, for example, when a consumer reaches upward to pull a bag from a dispenser mounted overhead, such as along the top of a produce case in a supermarket. The lower tongue is used, for example, when a consumer reaches downward to obtain a bag from a dispenser mounted in a relatively low position, for example along a candy counter in a supermarket or other store.

Preferably, the dispenser comprises an open wire structure. Preferably, the dispenser comprises stainless steel, and preferably the open wire structure comprises wire made from stainless steel.

As a second aspect, the present invention is directed to a bag dispensing system comprising a roll of individual interconnected plastic bags, the roll of bags having an axial passageway therethrough, and a dispenser in accordance with the first aspect of the present invention. Preferred dispensing systems utilize a preferred dispenser in accordance with the first aspect of the present invention. Although the wound roll of plastic bags can be coreless, preferably it has a core; the core can be flush with the sides of the roll of plastic bags, extending from each side of the roll of plastic bags, or flush with one side of the roll of plastic bags while extending from the other side of the roll of plastic bags.

Preferably, the plastic bags are folded so that they have a total of eight plies, with the bag having a seal star seal thereacross. The bags can be lay-flat end-seal bags, side-gusseted bags, or bottom-gusseted bags, or even other bags as described herein. Although the bags could comprise any one or more thermoplastic polymers, preferred polymers include polypropylene, polyethylene homopolymer, polyethylene copolymer, and polystyrene. More preferably, the bags comprise high density polyethylene (HDPE), low density polyethylene (LDPE), linear low density polyethylene (LLDPE), very low density polyethylene (VLDPE), and single site catalyzed polymers (preferably linear homogeneous ethylene/alpha-olefin copolymer or substantially linear homogeneous ethylene/alpha-olefin copolymer having long chain branching). Preferably, the bags are made from a 100% HDPE. Alternatively, preferred blends include blends of HDPE with LLDPE (5–20 weight percent) and HDPE with LDPE (5–20 weight percent).

Preferably, each of the bags has at least 4 contiguous plies; more preferably, at least 6 contiguous plies; still more preferably, at least 8 contiguous plies. Preferably, each of the bags is an end-seal bag in the sense that the bottom seal is across the bag. Preferably, each of the bags has a star seal and at least 8 contiguous plies.

Although the bag may be made from a monolayer film or a multilayer film, preferably the bag is made from a monolayer film. Although any thermoplastic, film-forming polymer may be used for the bag, preferred polymers include polypropylene, polyethylene homopolymer, polyethylene copolymer, polystyrene, polyamide, and polyester. More preferably, the bags comprise high density polyethylene (HDPE), low density polyethylene (LDPE), linear low density polyethylene (LLDPE), very low density polyethylene (VLDPE), and single site catalyzed polymers (preferably linear homogeneous ethylene/alpha-olefin copolymer or substantially linear homogeneous ethylene/alpha-olefin copolymer having long chain branching). Preferably, the bags are made from a 100% HDPE. Other preferred polymers include polypropylene, low density polyethylene, linear low density polyethylene, very low density polyethylene, and single site catalyzed (preferably linear homogeneous ethylene/alpha-olefin copolymer or substantially linear homogeneous ethylene/alpha-olefin copolymer having long chain branching. Preferred polymer blends include blends of HDPE with LLDPE (5–20 weight percent) and HDPE with LDPE (5–20 weight percent). HDPE is the preferred polymer for use in making the bag film.

Preferably, the film from which the bag is made is a monolayer film. Preferably, the film has a thickness of from 0.1 to 3; more preferably, 0.2 to 1.5 mils; and still more preferably, about 0.3 mil.

The bag in the open position, i.e., when in use, may vary in lay-flat width but is about 14 inches wide lay-flat. Preferably, the bags on the roll are folded so that they each have a width of from about 1 to 7 inches; more preferably, from about 3 to 6 inches; still more preferably, from about 3 to 5 inches; yet still more preferably, about 3¾ inches. Preferably, the axle is at about 1½ inches longer than the width of the roll.

Preferably, the roll of plastic bags is on an axle. Although the axle can be solid or hollow, preferably the axle is hollow. Preferably, the axle is longer than the roll is wide. Preferably, the core has a width of from about 2 inches to about 8 inches; more preferably, from about 4 to 6 inches; still more preferably, from about 4 to 5½; yet still more preferably, about 5¼ inches. Preferably, the axle is at about 1½ inches longer than the width of the roll. Alternatively, the roll of bags can be coreless, with either a hollow center or as a cylindrical roll without a hollow center.

Preferably, the film from which the bags are made is corona treated for ease of separation of the various plies.

DETAILED DESCRIPTION OF THE INVENTION

Figure 1:
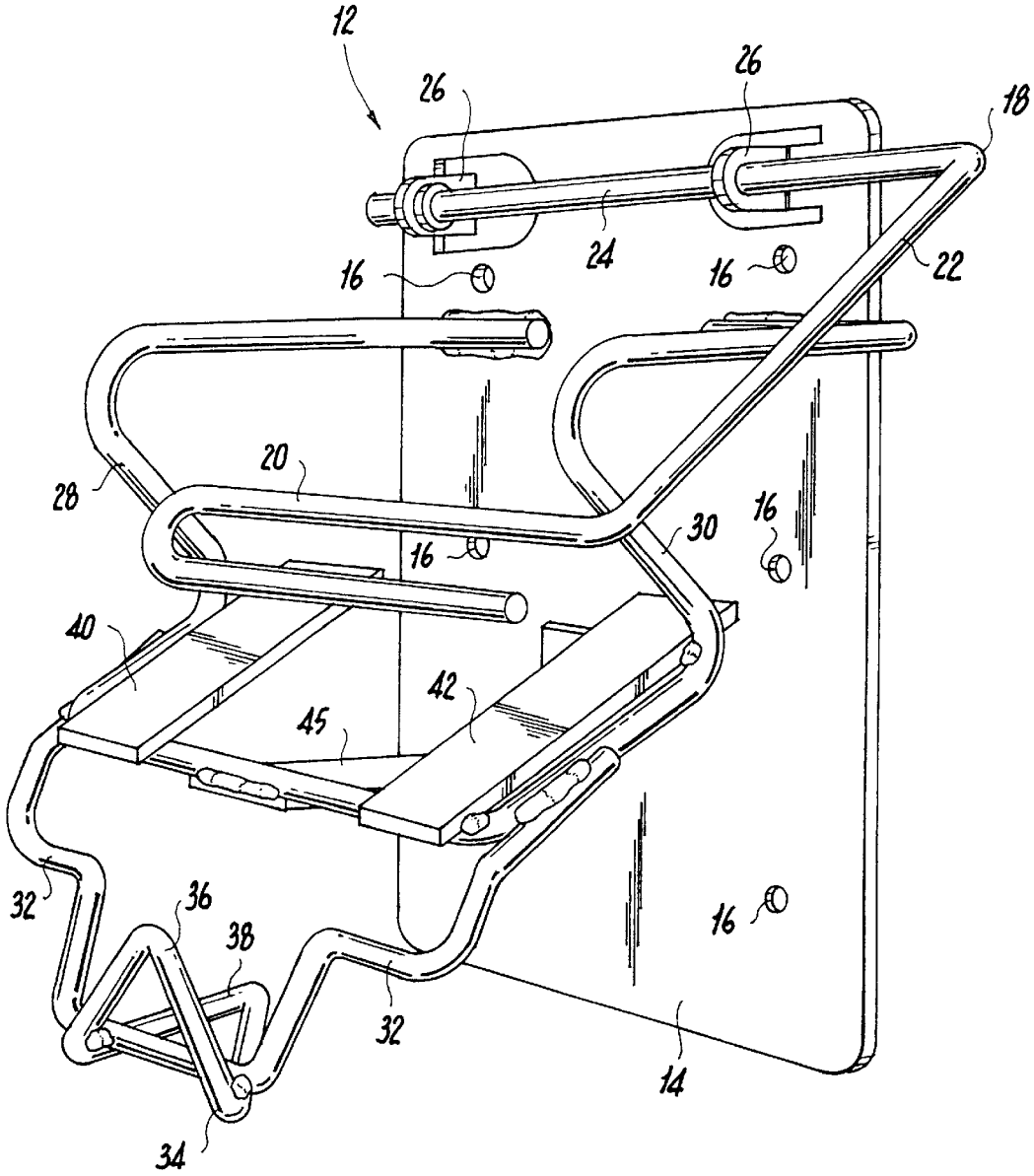
FIG. 1 is a perspective view of a preferred bag dispenser in accordance with the present invention, with the pivotable arm in a bag-dispensing position.
Figure 2:
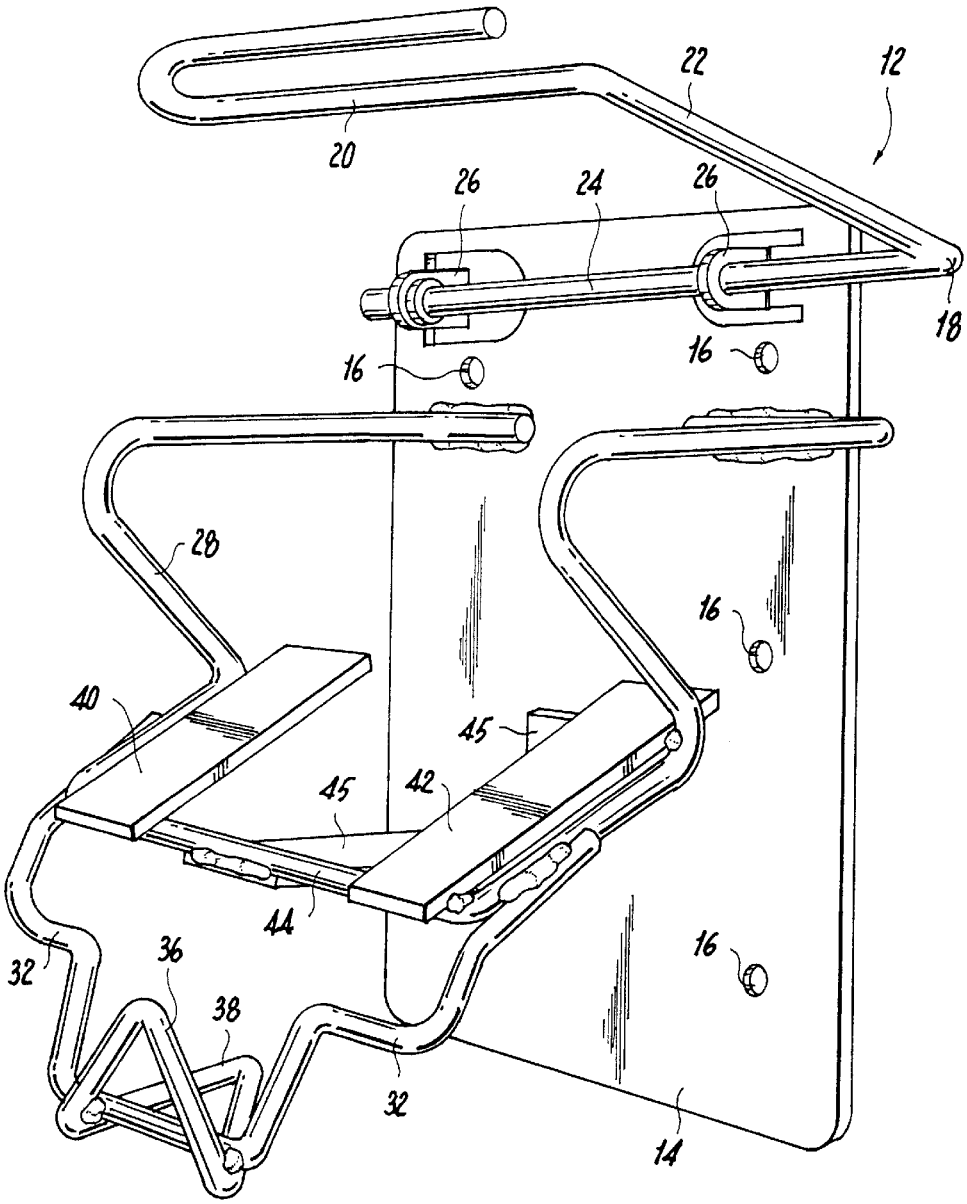
FIG. 2 is a perspective view of the dispenser of FIG. 1, with the pivotable arm in a roll-loading position.

Dispenser 12 of FIGS. 1 and 2 has dispenser support member 14 having a plurality of mounting holes 16 therein. The holes in dispenser support member 14 are provided to facilitate attachment of dispenser 12 to a support surface such as a wall or countertop. Dispenser support member 14 is preferably made from a thin metal plate with a plurality of holes 16 located for convenient attachment of dispenser 12 to a variety of surfaces, using fasteners such as screws, nails, brads, rivets, etc. Alternatively, dispenser support member 14 can be soldered, welded, brazed, etc. directly to any suitable support. Attached to dispenser support member 14 is pivotable arm 18 including axial portion 20, radial portion 22, and means for pivoting which includes pivot axle 24 and pivot axle retainers 26. As illustrated in FIG. 1, pivotable arm 18 is in a bag-dispensing position; in FIG. 2, pivotable arm 18 is in a roll-loading position. Also attached to dispenser support member 14 is first side rail 28 and second side rail 30, each of which are preferably welded to support member 14. Welded across the extending ends of side rails 28 and 30 is tongue support member 32, to which is welded double tongue 34, which is a diamond-shaped member containing upper tongue 36 and lower tongue 38. First and second peripheral brake plates 40 and 42 are welded to the lowermost portion of first and second side rails 28 and 30, respectively. Also supporting brake plates 40 and 42 is cross-member 44 (to which brake plates 40 and 42 are also welded) and central support bracket 45, which is welded to both cross member 44 and dispenser support member 14. Pivotable arm 18 is the only moving part of dispenser 12. As illustrated, axial portion 20 is "U-shaped", to provide a better fit into the passageway through the roll of bags, and to provide more weight to better control undesired movements of a depleted roll of bags during dispensing of bags therefrom.

As can be seen in FIGS. 1 and 2, dispenser 12 is of an open design, made mostly from heavy gauge bent wire or bar stock, which preferably has a diameter of from 3/16 inch to 5/16 inch. Preferably, all portions of dispenser 12 are made from stainless steel. This prevents rusting in the wet, humid environment of a grocery store produce section. Moreover, the open design minimizes the surface area which can attract dust, etc., allowing materials to fall through the dispenser rather than deposit on the surface of the dispenser.

Figure 3:
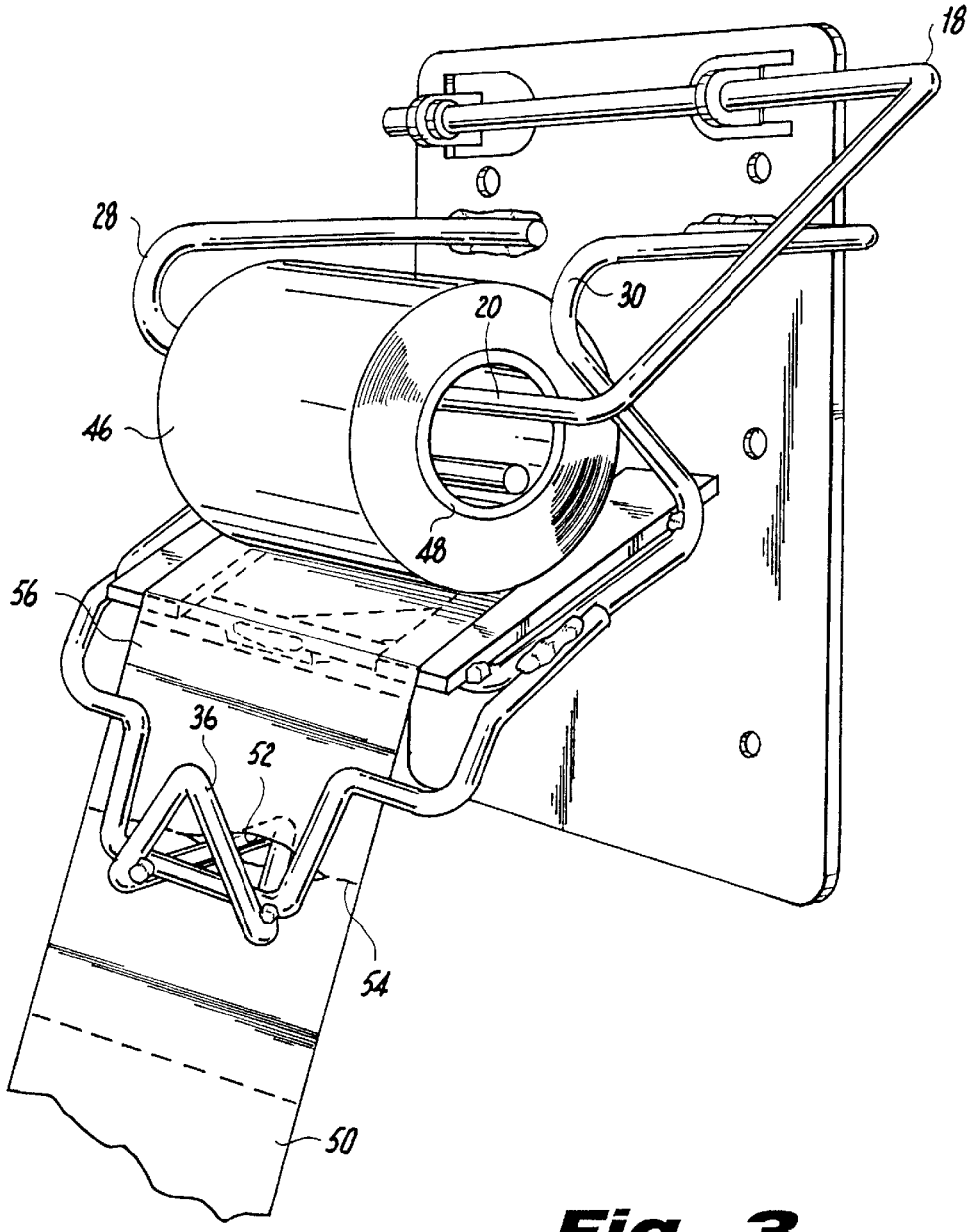
FIG. 3 is a perspective view of a preferred bag dispensing system utilizing the preferred dispenser of FIG. 1, with a partially-depleted roll of bags thereon, with the pivotable arm in a bag-dispensing position, and with a bag being dispensed.
Figure 4:
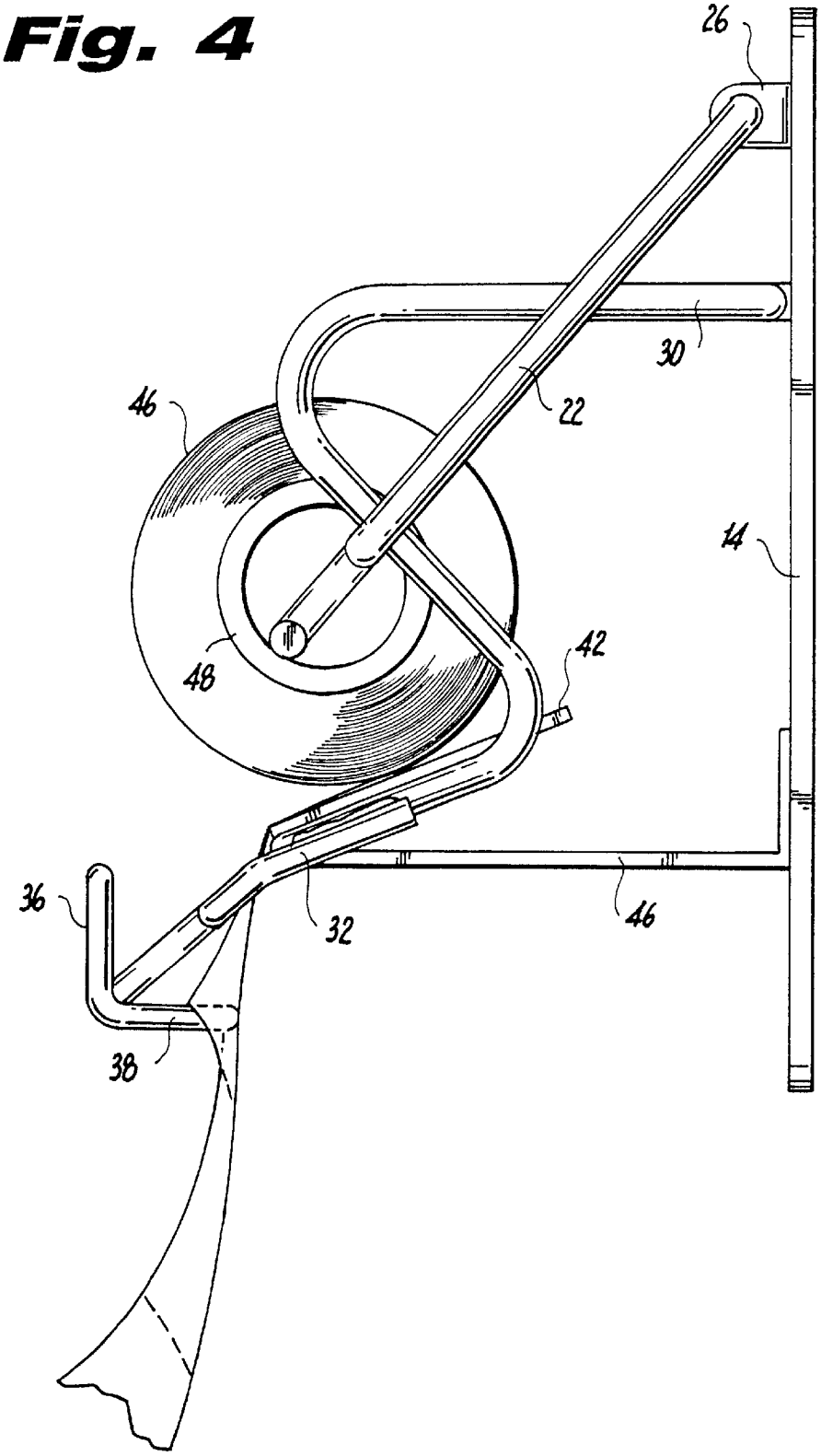
FIG. 4 is a side view of the bag dispensing system of FIG. 3, illustrating a bag in the process of being torn off from the next bag upstream.

FIGS. 3 and 4 illustrate a bag dispensing system utilizing the preferred dispenser of FIGS. 1 and 2. In FIGS. 3 and 4, roll of bags 46 is rolled onto hollow plastic core 48. Hollow core 48 has a passageway through which extends U-shaped axial portion 20 of pivotable arm 18. As illustrated in FIGS. 3 and 4, roll of bags 46 is largely depleted. Nevertheless, roll of bags 46 remains confined in its axial movement by side rails 28 and 30. Moreover, pivotable arm 18 provides additional weight to press the outer, curved surface of roll of bags 46 against brake plates 40 and 42, so as to maintain a smooth rotation of roll of bags 46 during dispensing, and to prevent excessive freewheeling thereof, as roll of bags 46 becomes still further depleted from further dispensing of bags therefrom.

As illustrated in FIGS. 3 and 4, roll of bags 46 is being unrolled to dispense downstream bag 50 by snagging slit 52 on upper tongue member 36. Continued pulling on downstream bag 50 will result in tearing across perforations 54, thereby separating downstream bag 50 from next upstream bag 56. Preferably, only one bag is dispensed at a time, with the tearing action forming a new open top for the bag being dispensed, and a new bottom edge for the next bag upstream.

Figure 5:
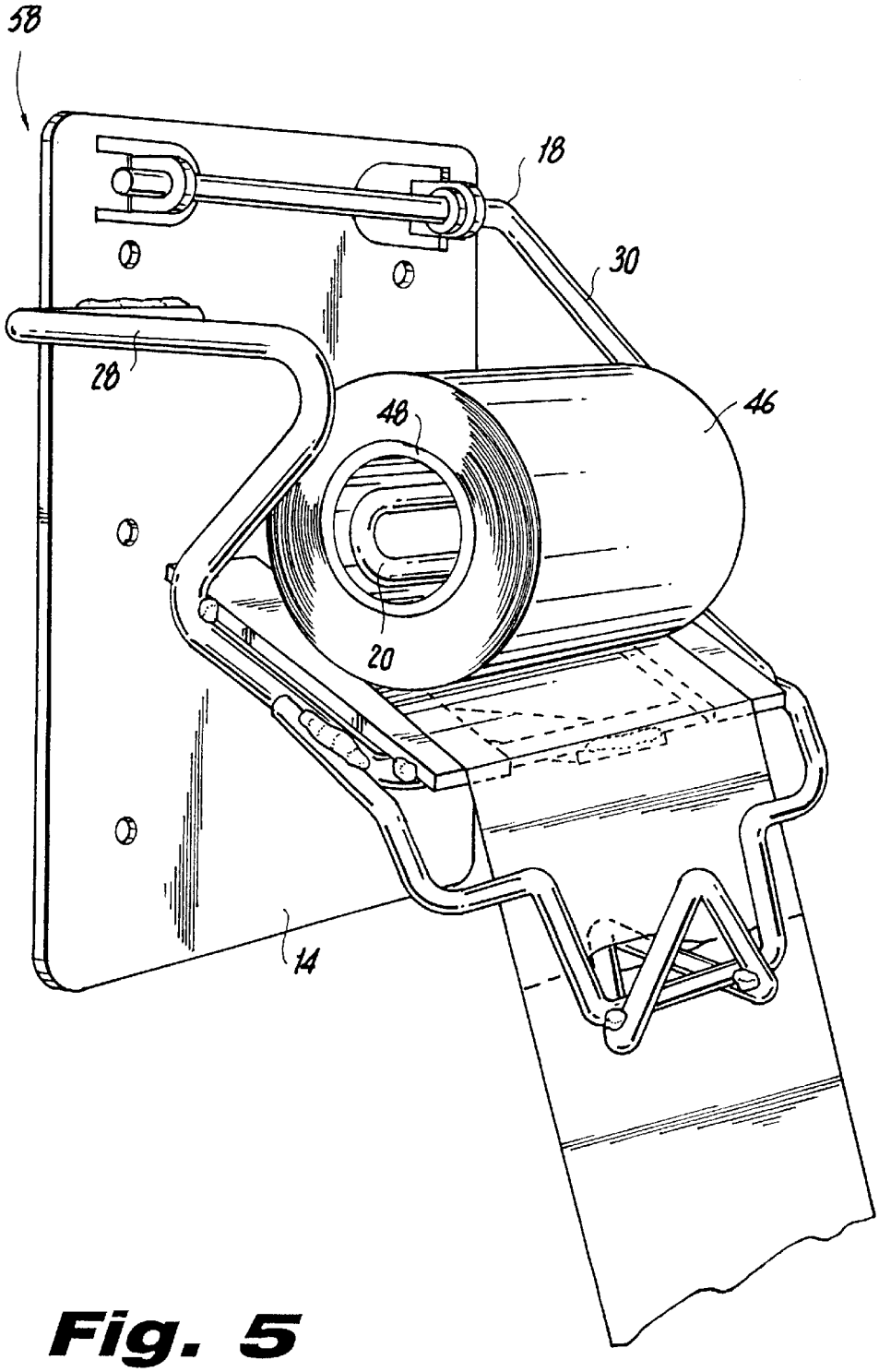
FIG. 5 is a perspective view of an alternative bag dispensing system having only one side rail, as it uses a portion of the pivotable arm to restrict axial motion of the roll of bags relative to the other side of the dispenser.

FIG. 5 illustrates an alternative bag dispensing system 58 in which the dispenser has first side rail 28, but utilizes, in place of a second side rail, radial portion 30 of pivotable arm 18 to confine the axial movement of roll of bags 46.

Figure 6:
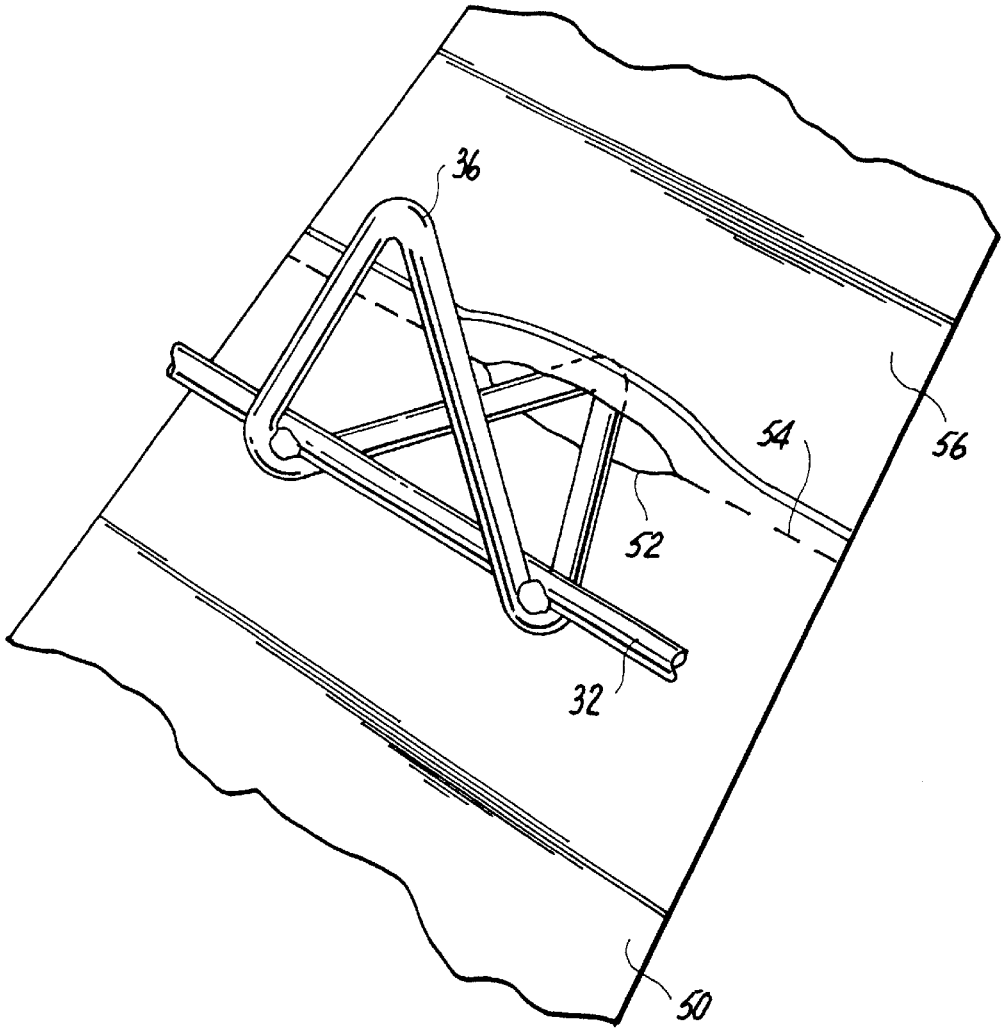
FIG. 6 is a detailed perspective view of the process of tearing off a bag.

FIG. 6 illustrates an enlarged, detail view of the initial snagging of slit 52 by upper tongue 36 as downstream bag 50 is pulled from roll of bags (46, see FIGS. 3 and 4) during the dispensing of downstream bag 50. Further pulling forces slit 52 down onto flaring upper tongue 36, causing an outward tearing from the slit in both directions along perforation line 54. In this manner, downstream bag 50 is separated from upstream bag 56 during the process of dispensing by a consumer.

Figure 7:
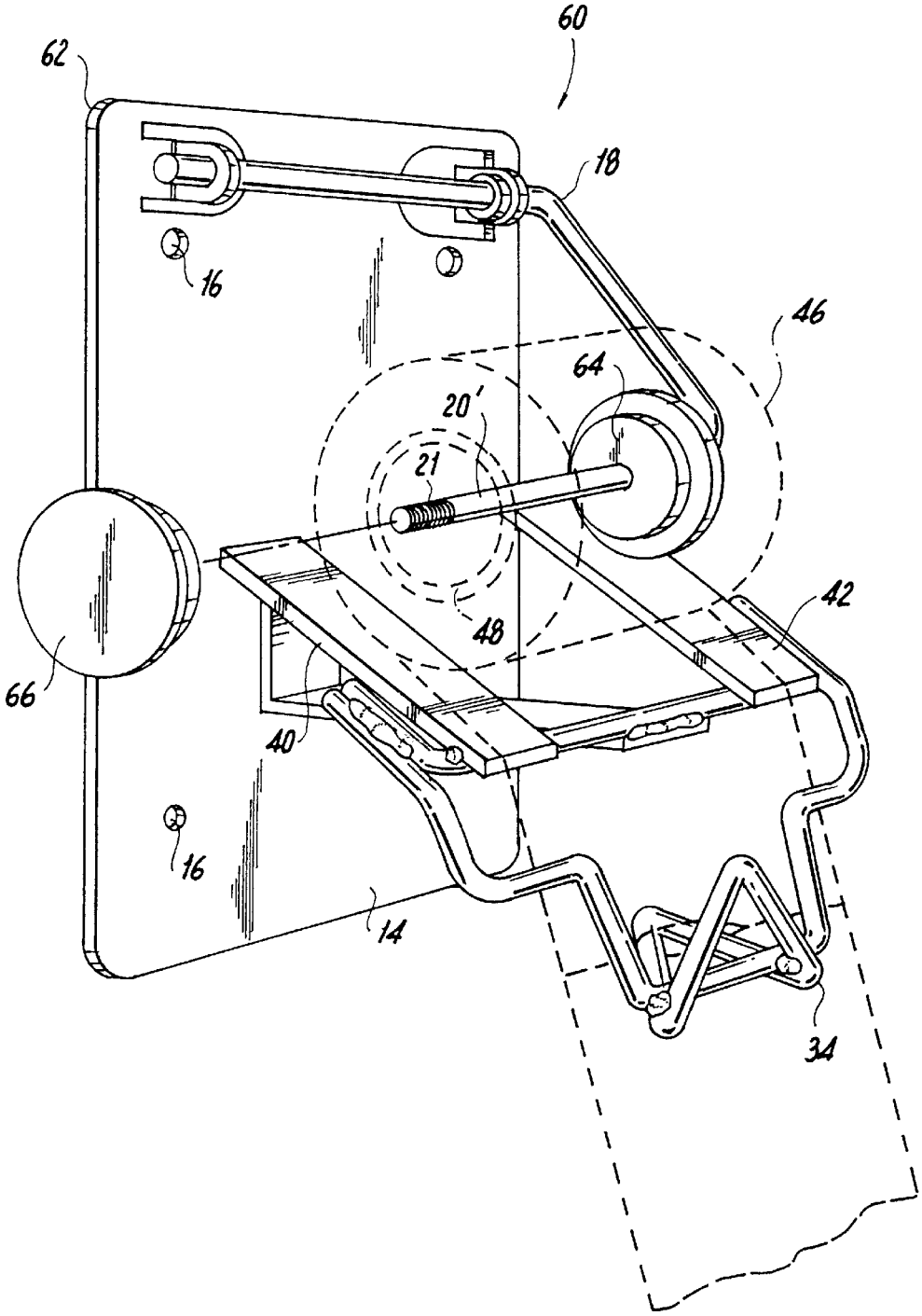
FIG. 7 is a perspective view of a first alternative dispenser and bag dispensing system which does not utilize the side rails illustrated in the preferred dispenser illustrated in FIG. 1.

FIG. 7 illustrates a perspective view of an alternative dispensing system 60 in which dispenser 62 has many of the same features as dispenser 12 of FIGS. 1 and 2, described above, such as dispenser support member 14, mounting holes 16, brake plates 40 and 42, tongue support member 32, double tongue 34, etc. However, pivotable arm 18' differs from pivotable arm 18 of the dispenser in FIGS. 1 and 2, in that pivotable arm 18' does not have U-shaped axial portion 20, but rather has linear axial portion 20' with outward threaded end 21. Moreover, roll of bags 46 having hollow core 48 (with ends flush with roll of bags 46) is centered around axial portion 20' due to the installation of inward adapter 64 and outward adapter 66. Outward adapter 66 threadedly engages outward threaded end 21 of linear axial portion 20' of pivotable arm 18'. In this manner, roll of bags 46 is retained on pivotable arm 18' without the presence of either of side rails 28 and 30 in the dispenser of FIG. 1. In addition, adapters 66 and 64 could be designed to provide added friction against overrotation (i.e., freewheeling) of roll of bags 46 during dispensing.

Figure 8:
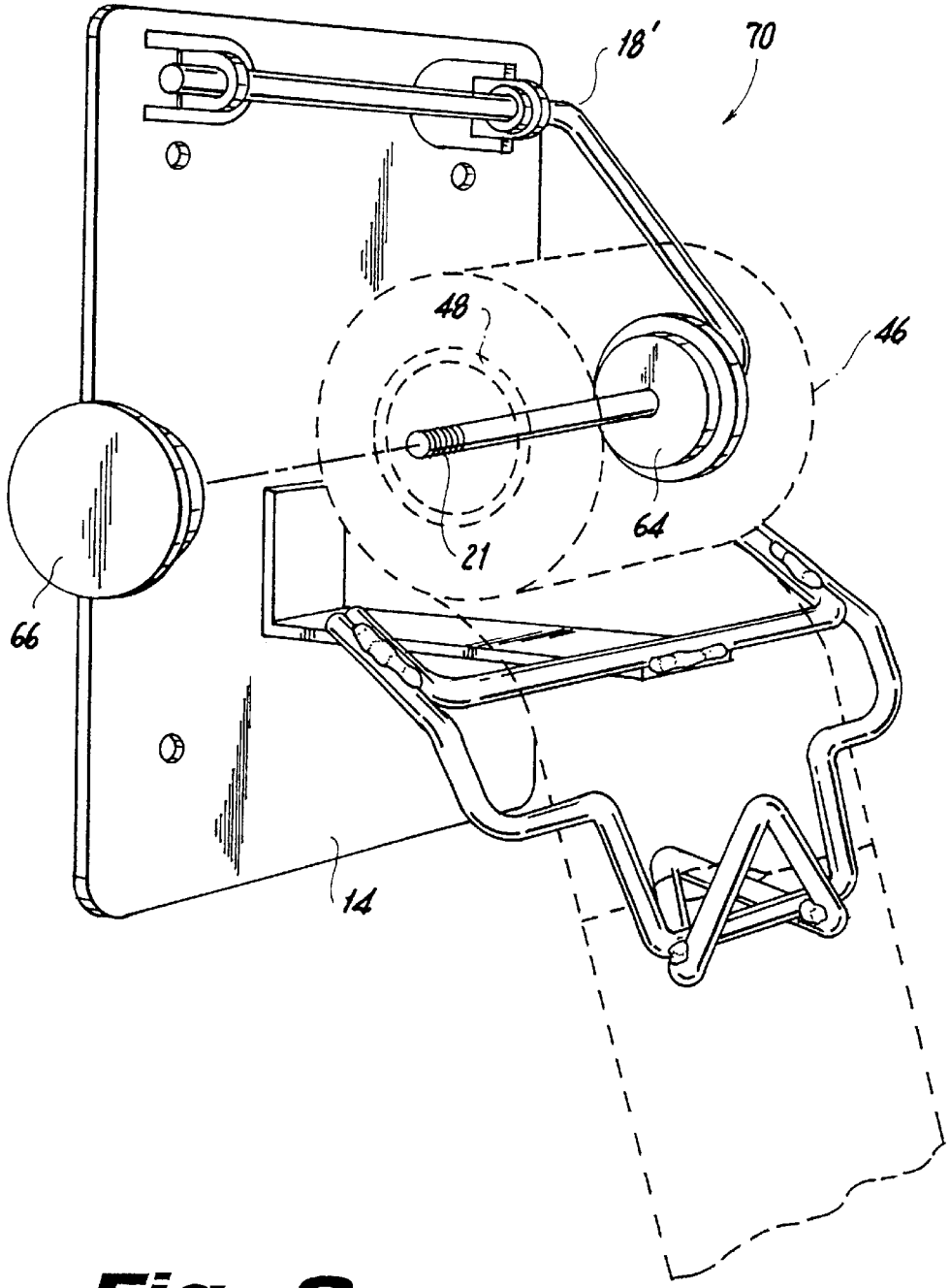
FIG. 8 is a perspective view of a second alternative dispenser and bag dispensing system which does not utilize either side rails or braking plates illustrated in the preferred dispenser of FIG. 1.

FIG. 8 illustrates yet another alternative dispensing system 70 which is similar to the dispensing system of FIG. 7, except that dispensing system 70 does not contain brake plates 40 and 42 illustrated in FIG. 6. Rather, in dispensing system 70, roll of bags 46 is in direct contact with the surface of dispenser support member 14, with the friction between the curved outer surface of roll of bags 46 and dispenser support member 14 providing friction to oppose undesired freewheeling during dispensing of bags.

Figure 9:
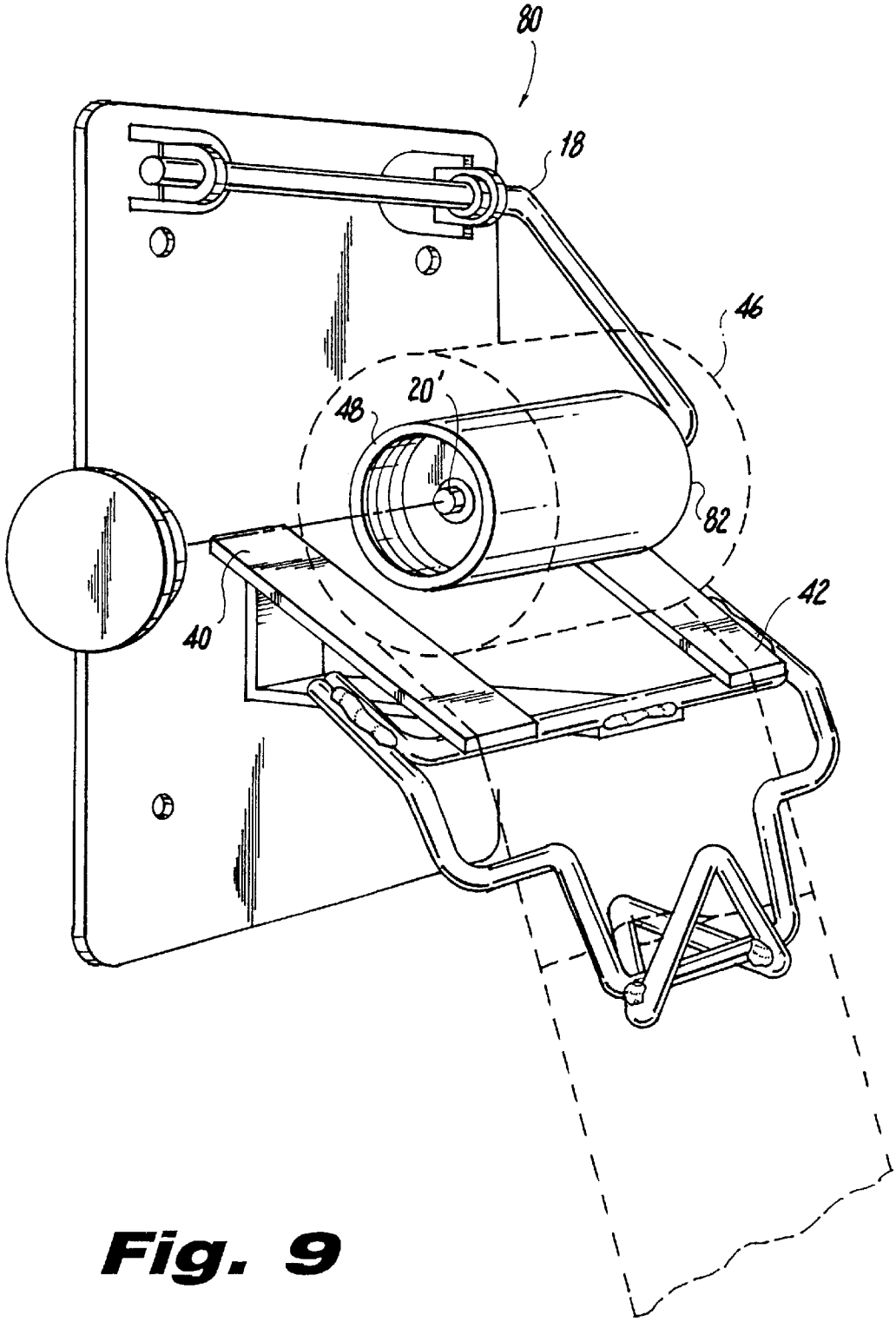
FIG. 9 is a perspective view of a third alternative dispenser and bag dispensing system which does not utilize side rails and which utilizes a cylinder over the axial portion of the pivotable arm.

FIG. 9 illustrates yet another alternative dispensing system 80 which is similar to the dispensing system of FIG. 6, except that axial portion 20' of pivotable arm 18 has cylinder 82 installed thereon. Cylinder 82 fits within the passageway through hollow core 48, against the inside surface of hollow core 48. Cylinder 82, in turn, has axial portion 20' passing therethrough. Cylinder 82 is designed for frictional engagement with axial portion 20', to provide additional friction to oppose the undesirable freewheeling of roll of bags 46 during dispensing of bags. Dispensing system 80 also has brake plates 40 and 42 upon which roll of bags 46 rests. Thus, dispensing system 80 has dual means for braking.

Although the dispensing systems of FIGS. 5, 7, 8, and 9 may have fewer parts than the dispensing systems of FIGS. 3 and 4, they are overall less preferred to the dispensing system of FIGS. 3 and 4 because they do not offer the ease of installation of the roll of bags. Moreover, the degree of braking obtained with the dispensing system of FIG. 8 is significantly less than the degree of braking obtained for the dispensing systems of FIGS. 3, 4, 5, 7, and 9.

Figure 10:
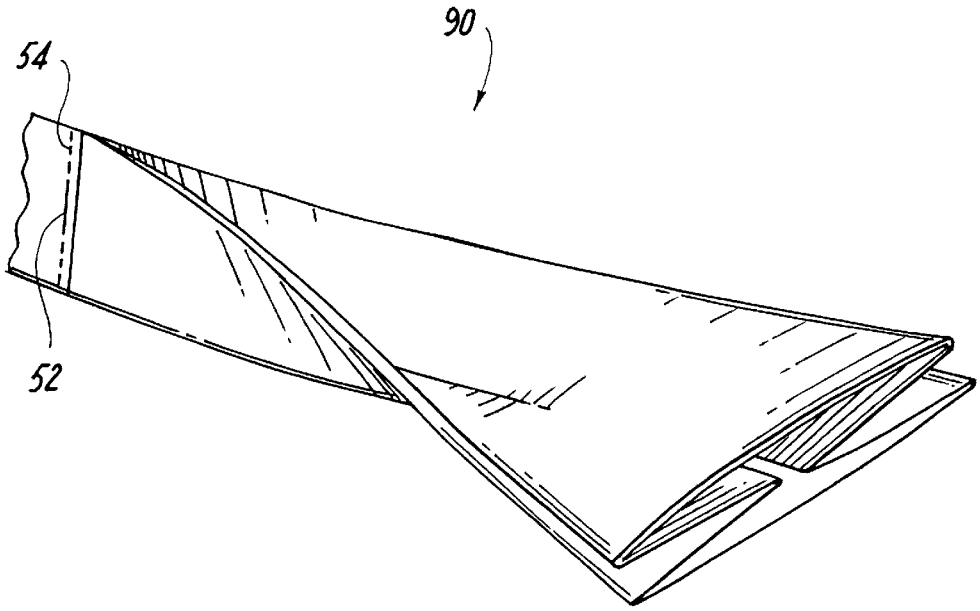
FIG. 10 illustrates a perspective view of a star-seal bag for use in a preferred bag roll in accordance with the dispensing system of the present invention.

FIG. 10 illustrates a preferred star seal bag 90 for use in the dispensing system and the roll of bags therefor. The bag is preferably made by gusseting, folding and sealing a segment of a seamless tubing (although a backseamed tubing could alternatively be used). Preferably, the bag is made by folding a seamless tubing to form gussets along each of the side edges thereof. Preferably, the gussets are so deep that they almost touch. Thereafter, the gusseted tubing is folded once lengthwise, down its center. While the gusseting produced four contiguous plies, and lengthwise folding doubles the four contiguous plies to result in eight contiguous plies. All eight contiguous plies of the gusseted, folded bag are then sealed together with a heat seal made across the folded tubing, through all eight plies, resulting in a star seal. A line of perforations having a centrally-located slit is preferably made in an area from about ⅛ to ½ inch below the seal. The sealing a perforating are repeated along the folded tubing at intervals corresponding with any desired bag length, with the resulting folded, sealed, perforated tubing being wound upon a hollow plastic core.

The plastic bags are especially intended for use as produce bags in supermarkets or food markets, for packaging fresh fruits and/or vegetables, as well as for packaging pieces of candy and other loose items being sold. It is to be understood however, that the bag dispensing system may be utilized for dispensing plastic bags from a wound roll for any particular use while remaining within the spirit of the invention.

Although the bags can be star-sealed bags as illustrated in FIG. 10, alternatively the bag can be folded in a so-called "C-fold" as disclosed in copending U.S. Ser. No. 09/642,138, to West et al., entitled "Bag Dispensing System And C-Fold Bag Used Therewith", filed Aug. 18, 2000, which is hereby incorporated in its entirety, by reference thereto. As illustrated in the aforementioned application, optionally the C-fold bags can also be handle bags, also commonly referred to as "T-shirt bags."

Figure 11:
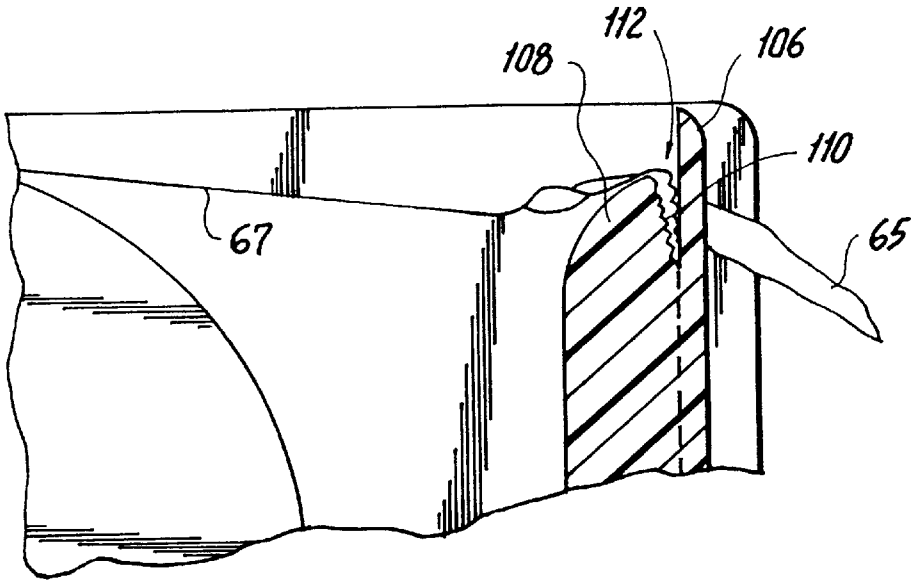
FIG. 11 is a side view of a tongue-and-finger combination which can be used on the dispenser illustrated in FIG. 1 and described herein.

FIG. 11 illustrates alternative feature which can be used in the dispenser and dispensing system in accordance with the present invention. FIG. 11 illustrates an alternative paired tongue-and-finger which can be substituted for upper tongue 36 and/or lower tongue 38 as illustrated in FIG. 1. More particularly, paired tongue-and-finger illustrated in FIG. 11 comprises tongue 106 and finger 108, with gap 112 therebetween. Tongue 106 extends upward above finger 108, so that tongue 106 snags the slit or slot between the bags. While further pulling by the consumer tears downstream bag 65 off of next upstream bag 67 by propagating a tear along the line of perforations between the bags, the downstream end of bag 67 is retained in gap 112 between tongue 106 and finger 108. Preferably a downstream surface of finger 108 has teeth 110 thereon, the teeth being designed to hold the downstream end of bag 67 with minimum force for extrication of bag 67 from gap 112, avoiding damage to bag 67. The tongue-and-finger combination is described in U.S. Pat. No. 5,558,262, which is hereby incorporated in its entirety by reference thereto. The tongue-and-finger combination can be used with just one upstanding tongue member, or with a double tongue member, in which each of the doubled tongues would have a finger associated therewith.

Although the bags are preferably present on the roll as a continuous strand of interconnected bags separated from one another by a line of perforations and a centrally-located slit, as an alternative the bags can instead be rolled into a roll in separated, interleaved fashion as disclosed in copending U.S. Ser. No. 09/641,739, to Kannankeril et al., entitled "Bag Dispenser And Bag Dispensing System Employing Roll of Interleaved Bags", filed Aug. 18, 2000, which is also hereby incorporated in its entirety by reference thereto. As disclosed in the interleaved roll application, the dispenser used to dispense the bags need not have a tongue or finger if a roll of interleaved bags is utilized.

It will be apparent to those skilled in the art that many modifications and substitutions can be made to the foregoing preferred embodiment without departing from the spirit and scope of the present invention, which is defined by the appended claims.

What is claimed is:

1. A dispenser for serially dispensing plastic bags from a wound roll of plastic bags, the dispenser comprising:

(A) a support member which can be attached to a support surface;

(B) a braking surface contacting the wound roll of bags to prevent freewheeling of the wound roll during dispensing of individual bags;

(C) a pivotable arm attached to the support member for supporting the wound roll of bags, the pivotable arm including means for pivoting from a roll-loading position to bag-dispensing positions in which the pivotable arm drops to allow the wound roll of bags to maintain contact with the braking surface as the bags are dispensed, the pivotable arm further comprising:

(i) an axial portion having a free end for installation thereon of the wound roll of bags; and (ii) a radial portion extending from the support member to the axial portion; and (D) means for limiting axial movement of the roll of bags on the pivotable arm when the pivotable arm is in the bag-dispensing position; and (E) a tongue attached directly or indirectly to the support member, the tongue being positioned for engaging an opening between bags during dispensing of the bags.

2. The dispenser according to claim 1, wherein the means for pivoting comprises a hinge between the support member and the radial portion of the pivotable arm.

3. The dispenser according to claim 1, wherein the means for limiting the axial movement of the roll of bags on the pivotable arm comprises a side rail attached to the support member, the side rail being on a first side of the dispenser which corresponds with the free end of the axial portion of the pivotable arm.

4. The dispenser according to claim 3, wherein the means for limiting the axial movement of the roll of bags on the pivotable arm further comprises a second side rail attached to the support member, wherein the second side rail is on a second side of the dispenser which corresponds with the radial portion of the pivotable arm.

5. The dispenser according to claim 1, wherein the braking surface comprises a pair of narrow brake plates positioned to contact outer edges of the roll of bags.

6. The dispenser according to claim 1, wherein the dispenser is designed to accept and dispense three different types of rolls of plastic bags:

(A) a standard width roll of plastic bags wound on a core having end portions which extend axially from the wound roll of plastic bags;

(B) a standard width roll of plastic bags wound on a core having a first end portion which extends axially from the wound roll of plastic bags, and a second end portion which is flush with a side surface of the wound roll of plastic bags; and (C) a standard width roll of plastic bags wound on a core having ends which are flush with side surfaces of the wound roll of plastic bags.

7. The dispenser according to claim 1, wherein the tongue is a double tongue mounted on a tongue support member, the double tongue having an upper tongue extending above the tongue support member, and a lower tongue extending below the tongue support member.

8. The dispenser according to claim 1, wherein the dispenser comprises an open wire structure.

9. The dispenser according to claim 1, wherein the dispenser comprises stainless steel.

10. A dispensing system comprising:

(A) a roll of individual interconnected plastic bags having an axial passageway there through, said individual bags being interconnected by a perforated tear line including an opening located in a predetermined position within said tear line for separating said bags;

(B) a dispenser comprising:

(i) a support member which can be attached to a support surface and which provides support for a remainder of the dispenser;

(ii) a braking surface contacting the wound roll of bags to prevent freewheeling of the wound roll during dispensing of individual bags;

(iii) a pivotable arm attached to the support member for supporting the roll, the arm being sized to extend at least part way through the axial passageway through the roll, the pivotable arm being pivotable from a roll loading position to bag-dispensing positions in which the pivotable arm drops to allow the roll to maintain contact with the braking surface as the bags are dispensed, the pivotable arm comprising:

(a) an axial portion having a free end for installation of the roll of wound bags; and (b) a radial portion extending from the support member to the axial portion; and (iv) means for limiting axial movement of the roll of plastic bags on the pivotable arm when the pivotable arm is in the bag dispensing position; and (v) a tongue attached directly or indirectly to the support member, the tongue being positioned for engaging the opening between bags during dispensing of the bags.

11. The dispensing system according to claim 10, wherein the means for limiting the axial movement of the roll of bags on the pivotable arm comprises a side rail attached to the support member, the side rail being on a first side of the dispenser which corresponds with the free end of the axial portion of the pivotable arm.

12. The dispensing system according to claim 11, wherein the means for limiting the axial movement of the roll of bags on the pivotable arm further comprises a second side rail attached to the support member, wherein the second side rail is on a second side of the dispenser which corresponds with the radial portion of the pivotable arm.

13. The dispensing system according to claim 10, wherein the roll of plastic bags is coreless.

14. The dispensing system according to claim 10 wherein the continuous strand of bags is wound on a hollow core.

15. The dispensing system according to claim 14, wherein the hollow core has ends which are flush with the sides of the roll.

16. The dispensing system according to claim 14, wherein the hollow core has ends which extend from the sides of the roll.

17. The dispensing system according to claim 14, wherein the hollow core has a first core end which is flush with a first side of the roll, and a second core end which extends from a second side of the roll.

18. The dispensing system according to claim 15, wherein the means for limiting the axial movement of the roll of bags on the pivotable arm comprises a side rail attached to the support member, the side rail being on a first side of the dispenser which corresponds with the free end of the axial portion of the pivotable arm, and the first core end is positioned at or near a junction of the axial and radial portions of the pivotable arm, and the second core end extends past the side rail when the pivotable arm is in the bag-dispensing position.

19. The dispensing system according to claim 10, wherein the bags are folded so that they have a total of eight plies, with the bag having a star seal there across.

20. The dispensing system according to claim 18, wherein the bags comprise high density polyethylene, and the bags are made from a monolayer film having a thickness of about 0.3 mil, and the roll of bags has a width of about 3¾ inches.

* * * * *